United States Patent [19]

Yamaga et al.

[11] 4,038,511

[45] July 26, 1977

[54] METHOD FOR ELECTROPNEUMATIC CONVERSION

[75] Inventors: Joji Yamaga; Morio Jido, both of Tokyo, Japan

[73] Assignee: Agency of Industrial Science & Technology, Tokyo, Japan

[21] Appl. No.: 559,814

[22] Filed: Mar. 19, 1975

[30] Foreign Application Priority Data

May 21, 1974 Japan ..... 49-56956

[51] Int. Cl.[2] ..... B23K 9/00

[52] U.S. Cl. ..... 219/121 P

[58] Field of Search ..... 219/121 P, 383; 313/182–223, 231.3, 231.4, 317, 325; 315/111.2–111.9; 417/48, 49, 65, 73–75; 750/324, 531, 542

[56] References Cited

U.S. PATENT DOCUMENTS

| | | | |
|---|---|---|---|
| 2,961,577 | 11/1960 | Thomas et al. | 250/531 X |
| 3,405,728 | 10/1968 | Dexter | 417/48 X |
| 3,614,512 | 10/1971 | Errard | 417/48 X |
| 3,897,173 | 7/1975 | Mandroian | 417/73 |

OTHER PUBLICATIONS

"Ion Drag Pressure Generation", by O. M. Stuetzer, *J. of Applied Physics,* vol. 30, No. 7, July 1959, pp. 984–994.

*Primary Examiner*—J. V. Truhe
*Assistant Examiner*—Fred E. Bell
*Attorney, Agent, or Firm*—Kurt Kelman

[57] ABSTRACT

In a closed discharge chamber wherein a discharge electrode supported on an electric insulating material and an opposite electrode are arranged to confront each other, a high electric potential applied between said electrodes causes corona discharge to occur in the gas between the two electrodes. A method for control of pure fluid elements, fluid servomechanisms, etc. is disclosed which is accomplished by utilizing a phenomenon that the pressure of the gas within the closed discharge chamber increases in consequence of the occurrence of corona discharge and the increased pressure falls with the subsequent extinction of corona discharge back to the level existing before said corona discharge.

4 Claims, 10 Drawing Figures

Fig. 6
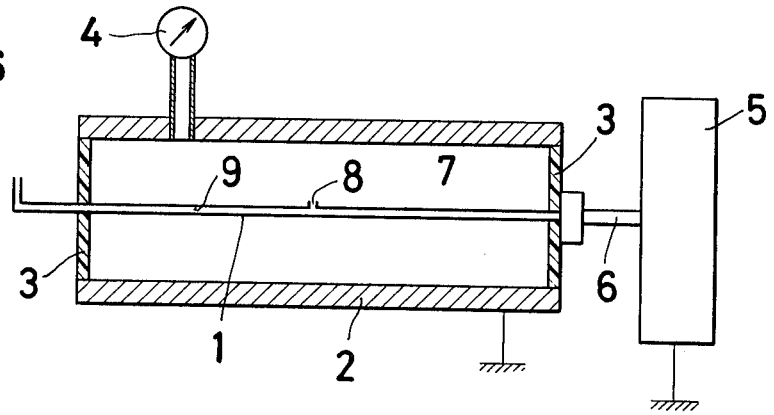
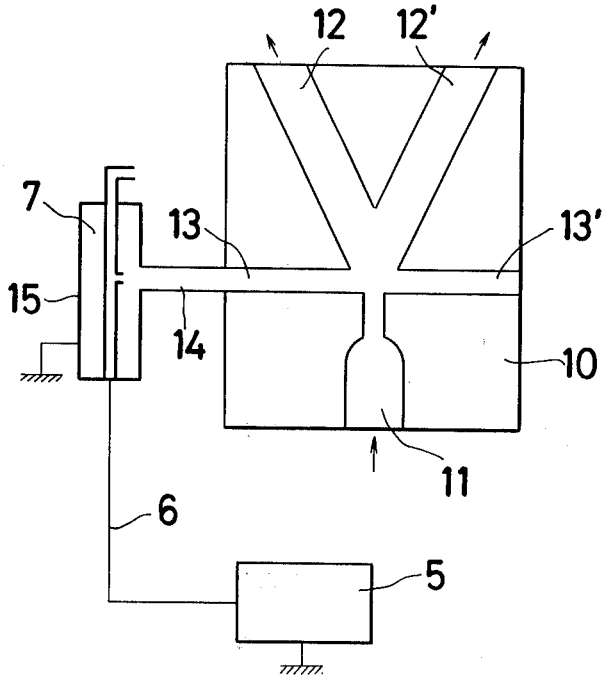
Fig. 9
Fig. 10
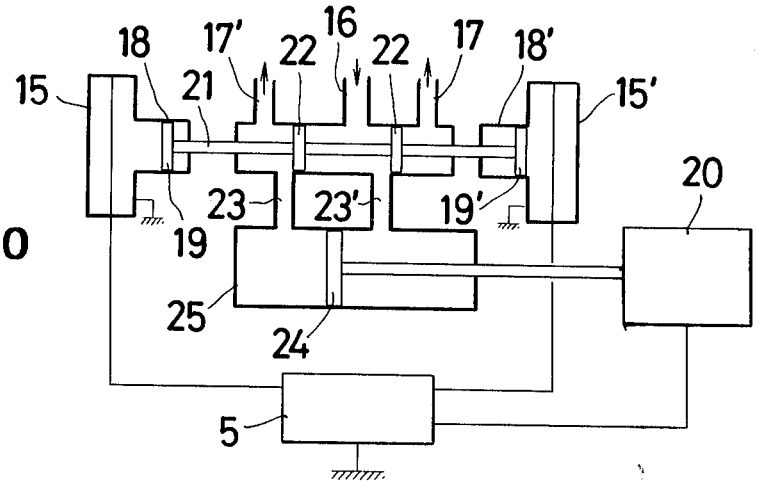

METHOD FOR ELECTROPNEUMATIC CONVERSION

BACKGROUND OF THE INVENTION

This invention relates to a method for electropneumatic conversion. More particularly, this invention relates to a method for electropneumatic conversion employing the phenomenon that the pressure of the gas in a closed discharge chamber increases in consequence of the occurence of corona discharge therein and the increased pressure falls, in consequence of the subsequent extinction of the corona discharge, back to the level existing before said corona discharge.

It is known that corona discharge occurs when the electric potential applied between two opposed electrodes in a gas is increased. It has been proposed to cool a part of said electrodes by using the ion storm which takes place in consequence of corona discharge (U.S. Pat. No. 3,224,497, for example).

The inventors pursued a further study on corona discharge. They have, consequently, discovered that when corona discharge is generated by applying a high electric potential between the two electrodes in a closed chamber, the pressure of the gas in the chamber increases in consequence of the corona discharge and the increased pressure falls, in consequence of the subsequent extinction of corona discharge, back to the level existing before said corona discharge. They have further ascertained that this phenomenon is much more powerful than the ion storm causable by corona discharge and takes place completely independently of the ion storm. The present invention has been accomplished on the basis of the discovery of this phenomenon.

The primary object of the present invention, therefore, is to provide a method for easily effecting electropneumatic conversion by virtue of the corona discharge which is caused by application of high electric potential.

Another object of this invention is to provide a method for electropneumatic conversion which permits ready control of the rate of increase or decrease of gas pressure, as well as of the intensity of pressure applied.

SUMMARY OF THE INVENTION

To accomplish the objects described above, the present invention provides a method for electropneumatic conversion utilizing, as its principle, the phenomenon that the pressure of a gas contained in a closed discharge chamber in which a discharge electrode supported on an electric insulating material and an opposite electrode are arranged to confront each other increases in consequence of corona discharge causable by application of a high electric potential between said two electrodes and the increased pressure of the gas falls, in consequence of the subsequent removal of said high electric potential and ensuing extinction of corona discharge, back to the level existing before said corona discharge. The fact that the positive pressure generated in consequence of the occurrence of corona discharge is approximately in proportion to the magnitude of high electric potential applied implies that the magnitude of the pressure of a gas in a closed chamber can easily be controlled. Control of the magnitude of gas pressure can also be attained by suitable selection of the manner of increase and decrease of the high electric potential applied, the shape of the discharge chamber, the shape and material of electrodes in use and the like.

The other objects and characteristics of the present invention will become apparent from the detailed description to be given herein below with reference to the accompanying drawings.

BRIEF EXPLANATION OF THE DRAWINGS

FIG. 6 is a sectional view illustrating another preferred embodiment of the electropneumatic conversion apparatus for practicing the method of this invention.

FIG. 9 is an explanatory diagram concerning the application of the method of this invention to the control of a pure fluid element.

FIG. 10 is an explanatory diagram concerning the application of the method of this invention to the control of a fluid servomechanism.

With reference to FIG. 1, a discharge chamber 7 is constructed of an opposite electrode 2 made of an electroconductive cylinder and stoppers 3 made of an electric insulating material and placed to close the openings tightly at the ends of said cylinder. Inside the discharge chamber 7, a discharge electrode 1 made of a thin electroconductive wire is stretched taut, with the ends thereof supported by the stoppers. One end of said discharge electrode is connected via a covered electric wire 6 to a high potential source 5. The opposite terminal of the high potential source 5 and the opposite electrode 2 are connected to a common ground. On the outside of said opposite electrode 2, a pressure gauge 4 is disposed in such a way as to communicate with the interior of the discharge chamber 7 and permit measurement of the pressure of gas inside the closed chamber. In an electropneumatic conversion apparatus having the aforementioned construction, when a high electric potential from the high potential source 5 is applied via the covered electric wire 6, the discharge electrode 1 generates corona discharge toward the opposite electrode 2 within the gas initially held under atmospheric pressure inside the closed chamber. The pressure inside the chamber changes as the magnitude of high electric potential applied is varied.

Figure 1:
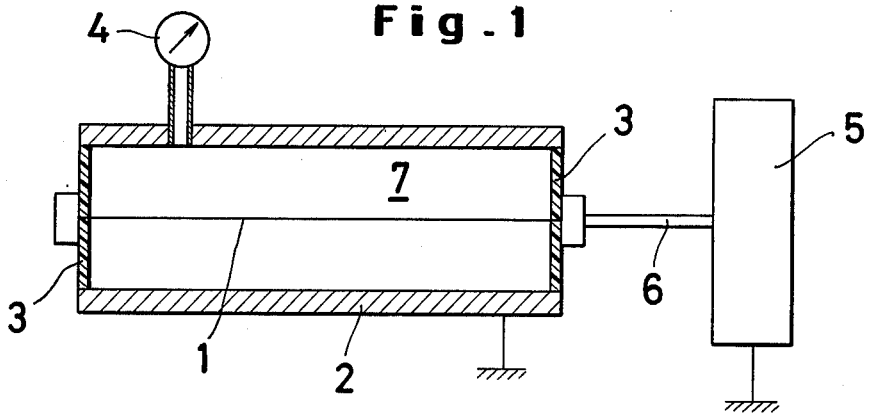
FIG. 1 is a sectional view illustrating one preferred embodiment of the electropneumatic conversion apparatus for practicing the method of this invention.
Figure 2:
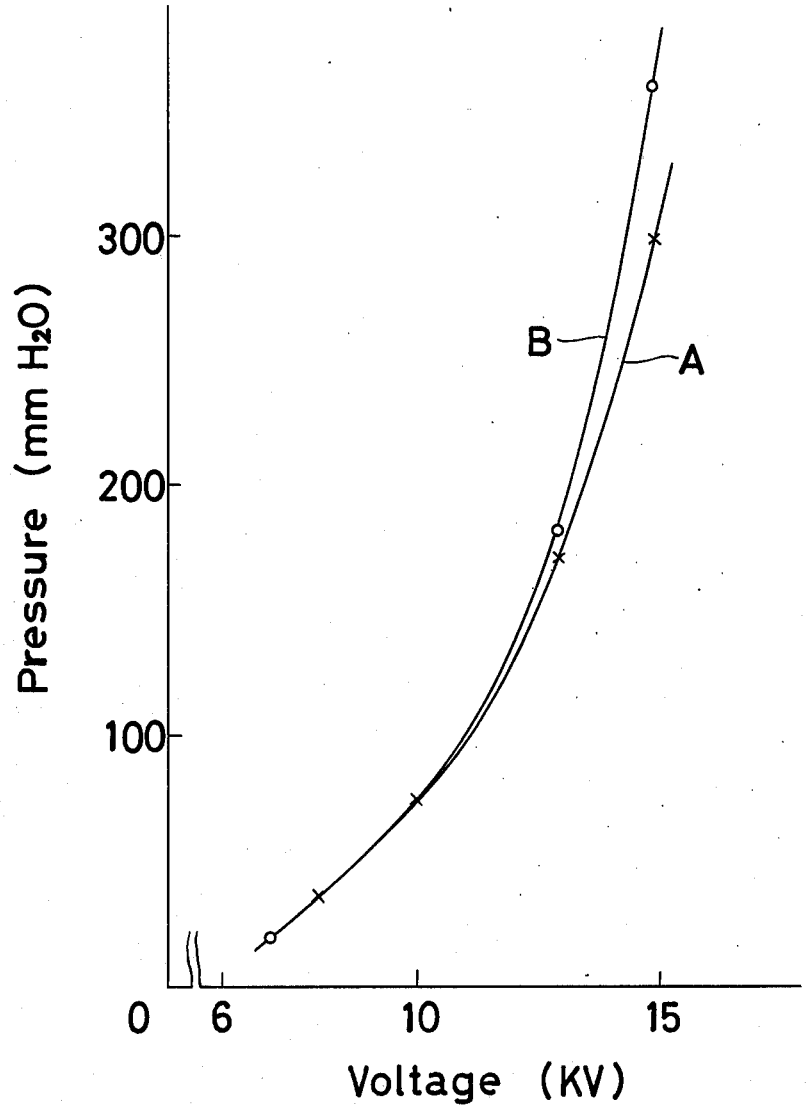
FIG. 2 is a graph showing a typical relationship between the magnitude of electric potential applied and the pressure condition within the closed discharge chamber determined by use of the electropneumatic conversion apparatus of FIG. 1.

For example, an electropneumatic conversion apparatus with a construction like the one shown in FIG. 1 was built using a nickel-chromium wire 0.3mm in diameter as the discharge wire electrode 1, a copper tube 100mm in length and 34mm in inside diameter as the opposite electrode 2 and discs mades of acrylic resin as the stoppers 3 for tightly sealing the ends of the tube. The interior of the chamber was maintained at atmospheric pressure with air (Curve A in FIG. 2) and argon gas (Curve B in FIG. 2), with the temperature fixed at 20° C and the humidity at 73%. The electric potential from the high potential source 5 was applied at varying values of 8 KV, 10 KV, 13 KV and 15 KV to the electrodes, with the discharge electrode 1 as the negative terminal. The results were as shown in FIG. 2. In FIG. 2, the values of the electric potential applied, the corresponding current and the maximum pressure calculated in terms of height of water column (in mm) are plotted. For each value of electric potential, the potential was first applied momentarily and, thereafter, (toward the right of the horizontal axis) fixed at the indicated level. FIG. 2 clearly indicates that the pressure of the gas inside the chamber is about 80mm of water column when the electric potential applied is 10 KV and it increases to about 300mm of water column when the potential is elevated to 15 KV and further that the rate of pressure increase inside the chamber is slightly greater when argon gas is used than when air is used.

Figure 3:
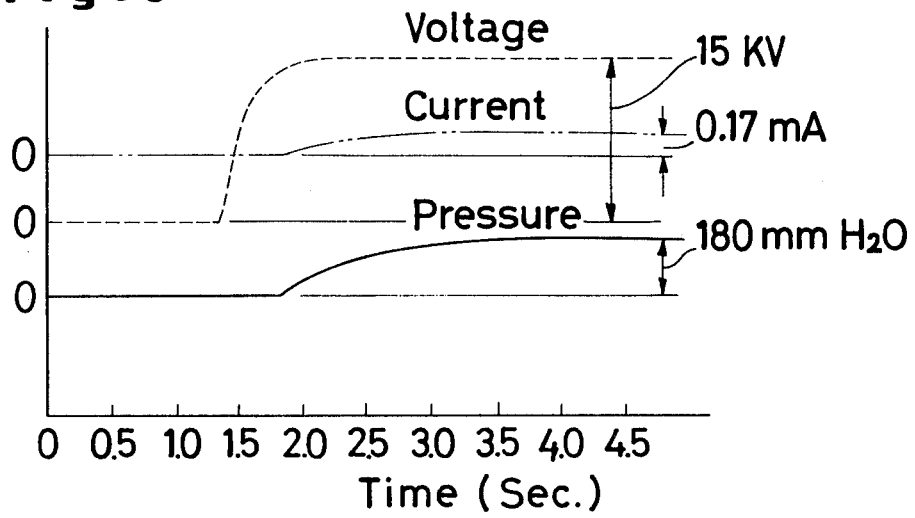
FIG. 3 and FIG. 4 are graphs showing relationships between the magnitude of electric potential applied and the pressure condition within the closed discharge chamber, as functions of time, determined in the electropneumatic conversion apparatus of FIG. 1.

FIG. 3 represents the results of another operation performed by using the same electropneumatic conversion apparatus as used in the operation whose results are indicated in FIG. 2, except that the discharge electrode had a diameter of 1mm. In this operation, the electric potential was gradually elevated (over a period of 0.5 second) up to 15 KV and this voltage was maintained thereafter (0.17 mA of amperage). When the electric potential had increased and remained at the elevated level for a fixed length of time, corona discharge began to occur and ionization ensued and, at the same time, the pressure inside the discharge chamber began to increase by degrees. After the pressure had reached about 180mm of water column, the chamber interior was allowed to remain under the resultant pressure condition.

Figure 4:
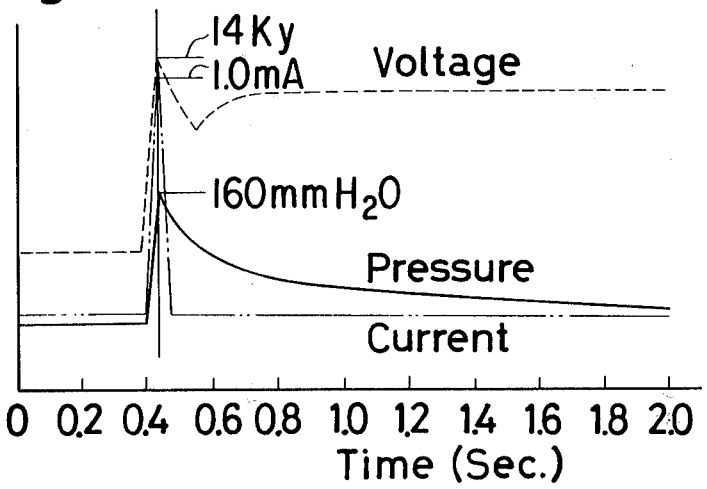

When, in the same electropneumatic conversion apparatus as used in the aforementioned operation, an electric potential lower than the point for generation of ionization voltage (point of maximum potential gradient) was momentarily applied to the electrodes, with the polarity of voltage application inversed (with the discharge electrode as the positive terminal), the condition of pressure inside the discharge chamber was changed as indicated in FIG. 4. It is seen that in the electric field of the electropneumatic conversion apparatus, the point of maximum potential gradient for ionization voltage falls in the neighborhood of 14 KV, that momentary generation of current ensues from the discharge and that the pressure inside the discharge chamber accordingly rises to about 160mm of water column. However, the magnitude of the pressure thus generated is correlated to the amperage at which the electric potential is applied, so that when the amperage returns to 0, the pressure is lowered.

Figure 5:
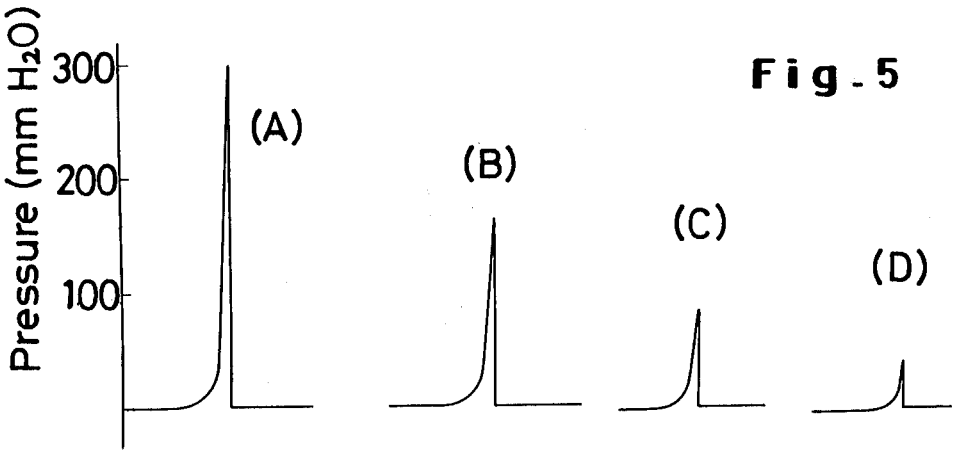
FIG. 5 is a graph showing the relationship between the electric potential applied and the maximum gas pressure produced in consequence of corona discharge generated by application of said electric potential.

When the diameter of the discharge electrode or the voltage of the electric potential applied is varied in the same operation, the condition of pressure inside the discharge chamber varies as shown in FIG. 5. For example, when a voltage of 14 KV (1.0 mA of amperage) was applied momentarily in a discharge chamber having a nickel-chromium wire 2mm in diameter stretched axially in a copper tube 24mm in diameter and 100mm in length, with the discharge electrode so fixed in polarity as to serve as the positive terminal, the pressure rose instantaneously to about 300mm of water column (FIG. 5 (A)). When the diameter of the copper tube was increased to 34mm and the diameter of the discharge electrode was decreased to 1mm, however, the pressure rose only to 160mm of water column when the electric potential of equal voltage and amperage was applied (FIG. 5(B)). When the voltage was lowered to 9 KV (0.45 mA of amperage), the pressure rose to about 80mm of water column as shown in FIG. 5(C). The pressure rose only to about 40mm of water column when the electric potential was applied at 7 KV (0.25 mA of amperage) as shown in FIG. 5(D).

Thus, the pressure increase of the gas can easily be controlled by varying the magnitude of the electric potential applied or by changing the dimensions of the discharge chamber.

Figure 7:
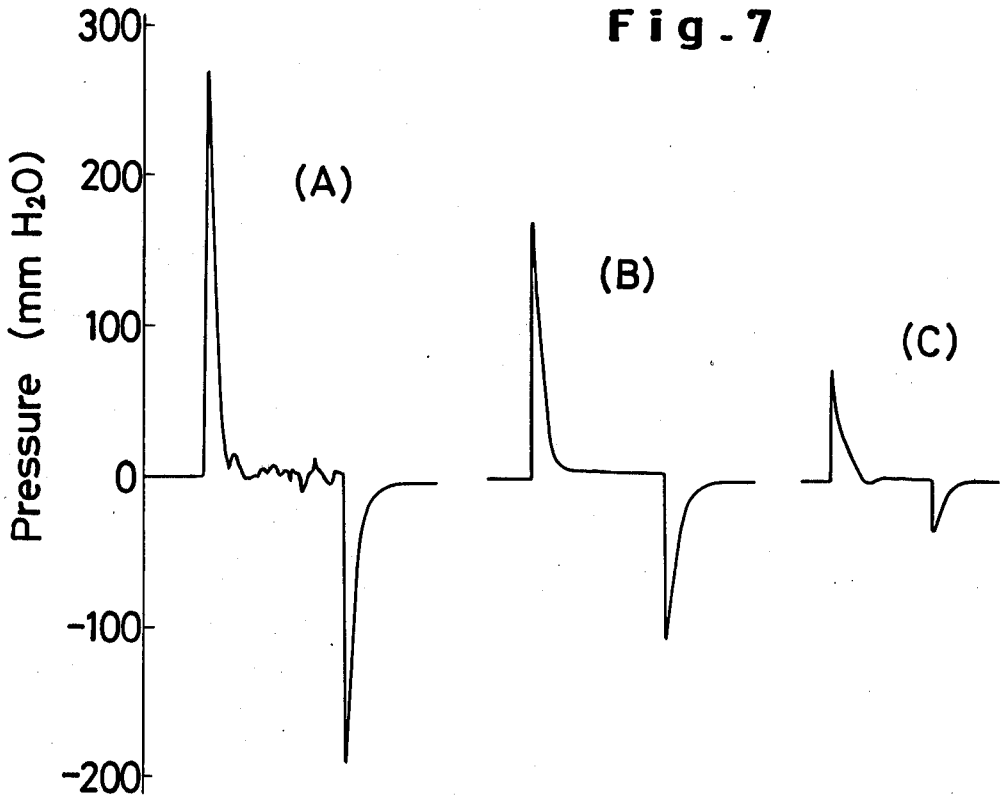
FIG. 7 is a graph showing the relationship between the electric potential applied and the positive pressure generated by the applied electric potential, determined in the electropneumatic conversion apparatus of FIG. 6.

FIG. 6 represents another preferred embodiment of the apparatus used for practicing the method of this invention. This apparatus is similar to the apparatus illustrated in FIG. 1, except that a thin tube having a fine bore 9 at the center is used as the discharge electrode 1. One end of this thin tube protrudes from the chamber 7 into the ambient air. Inside the discharge chamber 7, the interior of the thin tube communicates with the chamber interior through a pin hole 8 perforated in its wall. When a high electric potential is applied to the electropneumatic conversion apparatus of such construction, corona discharge occurs and at the same time the pressure inside the discharge chamber rises momentarily. However, the increased pressure inside the chamber immediately returns to the normal atmospheric pressure even if the corona discharge is left to continue. When the application of electric potential is stopped thereafter, the interior of the chamber momentarily assumes a condition of negative pressure. This phenomenon will be explained with reference to FIG. 7. FIG. 7(A) represents the results of appplication of an electric potential of 15 KV (0.7 mA of amperage) in an electropneumatic conversion apparatus having a construction similar to that of FIG. 1, except that a pipe 1mm in diameter containing a fine bore of 0.6mm along the axis and having a pin hole 0.1mm in diameter perforated in its wall for communication of the pipe interior with the chamber interior was used as the discharge electrode. In this case, the pressure inside the discharge chamber rose momentarily to about 270mm of water column and immediately returned to normal atmospheric pressure in spite of continued corona discharge. When the applied potential was removed, the pressure fall momentarily to −190mm of water column and immediately returned to atmospheric pressure. When the voltage of the electric potential applied was 10 KV (0.1 mA of amperage), however, the pressure rose only to 80mm of water column and fell only to −40mm of water column as shown in FIG. 7(C).

Figure 8:
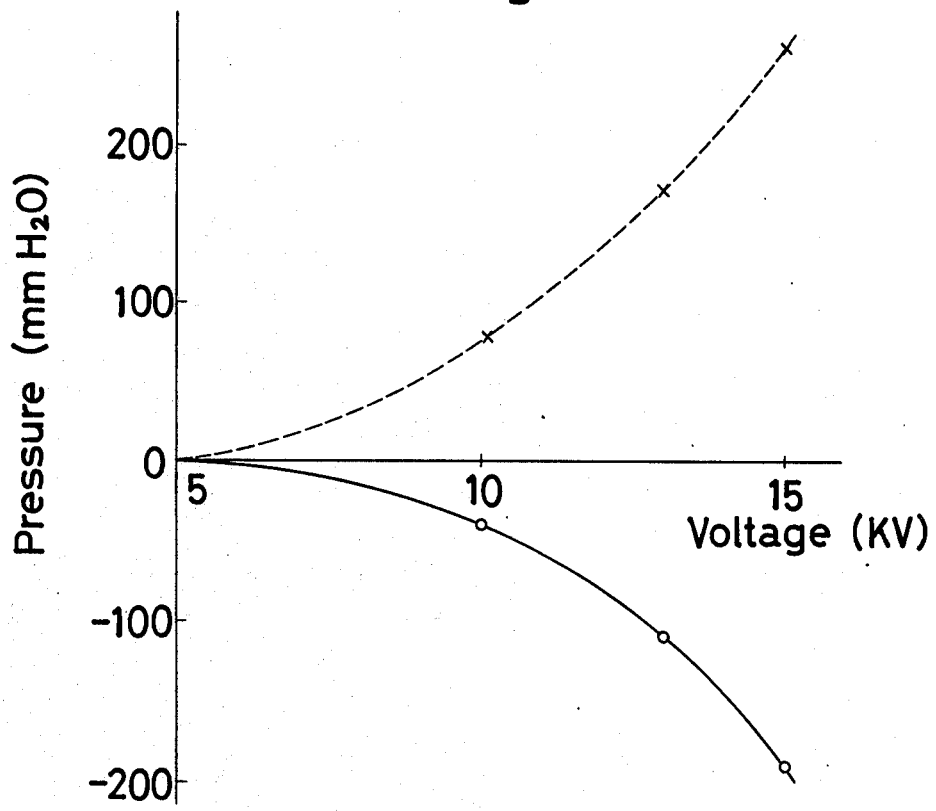
FIG. 8 is a graph showing the relationship between the electric potential applied and the maximum positive pressure and negative pressure generated by the applied electric potential, determined in the electropneumatic conversion apparatus of FIG. 6.

The relationship between the magnitude of electric potential applied and the maximum pressure generated and the maximum negative pressure attained in the aforementioned electropneumatic conversion apparatus is shown in FIG. 8. From the foregoing graphs it is apparent that the positive pressure is about 80mm of water column and the negative pressure is about −40mm of water column where the electric potential is 10 KV and they are about 270mm of water column and −190mm of water column respectively where the potential is 15 KV, indicating that the absolute values of positive and negative pressures attained within the chamber increase approximately in direct proportion to the magnitude of electric potential applied. The maximum pressure generated in consequence of corona discharge is decisively larger than the pressure of the ion storm also caused by the corona discharge (generally of the order of not more than 1mm of water column), indicating that the phenomenon is entirely different from that of iron storm.

The pin hole mentioned above functions as a valve. A pin hole drilled through the discharge chamber to permit direct communication between the chamber interior and the ambient air may serve as an effective substitute for the pin hole formed in the thin tube laid inside the discharge chamber.

The shape of the discharge chamber is not limited to a cylinder as used in each of the examples cited above. It can have any shape, so long as the chamber fulfils the requirement that it provides ample space between the two electrodes involved. For example, a discharge chamber having a discharge electrode 1 disposed at the center of a spherical opposite electrode 2, a rectangular discharge chamber having a discharge electrode 1 and an opposite electrode 2 disposed on the opposed faces of the rectangular shell thereof, and chambers of other suitable shapes are all usable.

As the discharge electrode and the opposite electrode for use in the discharge chamber according to the present invention, all electrodes which have heretofore been adopted for corona discharge can be used in their unmodified form. Examples of the discharge electrodes are those made of nickel, Ni-Cr alloy, iron, etc. Examples of the opposite electrodes which are usable are those made of copper, iron, etc. As the gas to fill the interior of the discharge chamber, air or any of the inert gases may be used. The particular gas to be used in the chamber is suitably selected by taking into consideration the nature of the system which is to be controlled by the electropneumatic conversion apparatus of the present invention. The electricity to be used for the application of electric potential to the electrodes is not limited to direct current. The desired control of the pressure inside the discharge chamber can also be obtained by using alternating current. The magnitude of electric potential to be applied is suitably selected to suit the system desired to be controlled, with due consideration paid to the principle that the pressure (absolute values of positive and negative pressures) inside the discharge chamber increases with the increasing magnitude of potential applied as shown in FIG. 8.

In the application of electric potential to the electrodes, the voltage may be applied starting either from zero or from a stand-by voltage which is less than the voltage at which corona discharge occurs. Further, the increase in potential from the initial voltage to the highest voltage to be applied may be accomplished instantaneously or stepwise or otherwise the potential may be raised linearly to the desired voltage over a brief period. When the time for pressure increase is elongated, however, the rate at which the pressure inside the discharge chamber increases tends to decrease as shown in FIG. 3.

When the aforementioned high electric potential is applied instantaneously to the electrodes, however, the interior of the discharge chamber assumes a positive pressure momentarily. When the increased potential is returned to the stand-by voltage, the increased pressure immediately returns to the level existing before the application of potential.

Removal of the electric potential applied to the electrodes may also be effected instantaneously, stepwise or linearly over a brief period of time. In the last case, the rate at which the pressure inside the discharge chamber falls tends to decrease with the increasing time for potential decrease.

As described above, quantitative control of the interior of the discharge chamber to the desired pressure (both positive and negative pressure) can be attained freely by suitably selecting the magnitude of electric potential to be applied, the manner of increasing and decreasing potential application, the shape of the discharge chamber, the shape and material of the electrodes used, the particular kind of gas used to fill the interior of the discharge chamber, etc. This quantitative control is reproducible.

An operation in which a pure fluid element is controlled by use of the electropneumatic conversion apparatus according to the present invention will be described with reference to FIG. 9.

In FIG. 9, a pure fluid element 10 is composed of a fluid inlet 11, two fluid outlets 12, 12' and two signal inlets 13, 13'. One of these signal inlets is connected via a tube 14 to the discharge chamber 7 of the electropneumatic conversion apparatus 15 of the present invention illustrated in FIG. 6.

While no electric potential is applied to the electrodes of the electropneumatic conversion apparatus, the projected fluid introduced through the fluid inlet 11 is discharged equally through the two fluid outlets 12, 12'. When a high electric potential is applied to the electrodes of said apparatus, the gas within the discharge chamber gains in pressure and is forced to flow through the pipe 14 into the signal inlet 13, causing the principal projected fluid to flow to the fluid outlet 12'. After that, the interior of the discharge chamber returns to the normal atmospheric pressure and the delivery of the gas to the signal inlet 13 is ceased, with the result that the projected fluid is equally discharged through the fluid outlets 12, 12'. When the potential is completely released afterward, the interior of the discharge chamber assumes the state of negative pressure to cause suction of the gas through the signal inlet 13. Consequently, the main projected fluid flows to the fluid outlet 12.

The proportion of the amounts of projected fluid to be discharged through the fluid outlets 12 and 12' is determined by the condition of positive or negative pressure attained inside the discharge chamber. The condition of the pressure inside the discharge chamber can be controlled freely as is evident from the foregoing description of the invention. This means that the flow of the fluid can freely be controlled by regulating the magnitude of high electric potential applied to the electrodes. The example just described presumes an embodiment in which the electropneumatic conversion apparatus is connected to the signal inlet 13. More complicated control of the pure fluid element can be attained by connection of an additional electropneumatic conversion apparatus of the present invention to the remaining signal inlet 13'.

Now, an example in which the electropneumatic conversion apparatus according to the present invention is employed for the control of a fluid servomechanism will be explained.

With reference to FIG. 10, a fluid servomechanism possessed of a fluid feed inlet 16, two fluid discharge outlets 17, 17' and two signal inlets 18, 18' each of the shape of an engine cylinder is combined with two electropneumatic conversion apparatuses 15, 15' according to the present invention, with the signal inlets of the fluid servomechanism and the discharge chambers of the electropneumatic conversion apparatuses connected by the medium of the pistons 19, 19' disposed inside said cylinders.

When a command signal from the load 20 is transmitted to the high potential source 5 and the source 5 delivers high electric potential in response to said command to the apparatus 15, the gas inside the discharge chamber gains in pressure and consequently pushes the piston 19 inside the cylinder 18, with the result that the spool piston 22 fastened to the same shaft 21 that is attached to the piston 19 is actuated to permit the hydraulic fluid to flow to the passage 23' and cause the piston 24 inside the operating cylinder 25 to move to the left. When a high electric potential is applied to the conversion apparatus 15' in response to the signal from the load 20, the spool piston 22 is pushed in the opposite direction, causing the hydraulic fluid to be forced through the passage 23 into the operating cylinder 25. As a result, the cylinder is moved to the right.

According to the present invention, therefore, the servomechanism can be controlled without difficulty, directly by the signal from the load as described above.

As described in detail above, the increase of the pressure inside the discharge chamber which occurs in consequence of the generation of corona discharge and the decrease of the pressure therein which occurs in consequence of the extinction of corona discharge are directly related to the voltage of the electric potential applied for the purpose of said corona discharge. The present invention, utilizing this principle, readily permits direct electropneumatic conversion, i.e., the conversion of applied electric potential to working gaseous pressure. The electropneumatic conversion apparatus according to the present invention, therefore, enjoys notable simplicity of construction and high reliability of operation as compared with the conventional electropneumatic conversion apparatuses and can be adopted for the control of various pneumatic devices.

What is claimed is:

1. An apparatus for electropneumatic conversion which comprises in combination, a discharge electrode supported by an electric insulating material, an opposite electrode disposed to confront said discharge electrode, said electric insulating material and opposite electrodes forming a discharge chamber, a gas disposed in said chamber, means for applying a high electric potential between said discharge electrode and said opposite electrode, pin hole means disposed for communicating said gas in the discharge chamber and the ambient air.

2. The apparatus of claim 1 wherein said discharge electrode is tubular, one end thereof extending into the ambient air, and a pin hole disposed in the portion of the electrode inside said discharge chamber whereby the interior of said discharge chamber is communicated with the ambient air via the hollow interior of said tube.

3. The apparatus of claim 1 having means for communicating the interior of said discharge chamber with a signal inlet of pure fluid element.

4. The apparatus of claim 1 having means for controlling a fluid servomechanism.

* * * * *